United States Patent [19]

Wolfe

[11] Patent Number: 4,751,982

[45] Date of Patent: Jun. 21, 1988

[54] FOLDABLE LADDER

[76] Inventor: Nicholas Wolfe, 4498 Forestglen Rd., Moorpark, Calif. 93021

[21] Appl. No.: 58,276

[22] Filed: Jun. 4, 1987

[51] Int. Cl.[4] ..... E06C 1/36

[52] U.S. Cl. ..... 182/164; 182/198; 182/206

[58] Field of Search ..... 182/150, 206, 164, 196, 182/152, 198, 156, 157, 163

[56] References Cited

U.S. PATENT DOCUMENTS

| | | | |
|---|---|---|---|
| 1,101,808 | 6/1914 | Michel | 182/164 |
| 1,859,984 | 5/1932 | Reese | 182/206 |
| 2,575,573 | 11/1951 | Wiedman | 182/152 |
| 3,307,654 | 3/1967 | Green | 182/198 |
| 3,344,886 | 10/1967 | Boscarino | 182/164 |
| 3,677,366 | 7/1972 | Loeffel | 182/164 |
| 4,189,030 | 2/1980 | Leslie | 182/196 |
| 4,231,449 | 11/1980 | Lauritas | 182/206 |

*Primary Examiner*—Reinaldo P. Machado

[57] ABSTRACT

A foldable ladder having a plurality of rigid steps and inwardly folding arms pivotably secured to the steps so as to be rigid in use by capable of being folded for storage.

6 Claims, 2 Drawing Sheets

FOLDABLE LADDER

FIELD OF THE INVENTION

The invention relates to foldable ladders of the type which are folded for storage in the event of an emergency at which time they can be unfolded and used to escape from an elevated structure. These ladders are often used as emergency fire escape means and may be secured in a container outside a window, for immediate use. Similar, though shorter ladders, are often used in boats to permit ease of returning into the boat from, for example, the water.

BACKGROUND OF THE INVENTION

Foldable ladders are well known and have been in use for many years. An extremely old and very common type of foldable ladder is a so-called rope ladder. These usually comprise a series of elongated rigid steps maintained approximately parallel to each other by two ropes, one secured to each end of the steps. The rope permits rolling the ladders into a cylindrical bundle.

Several types of storable, foldable fire escape devices are known. Such devices are described in U.S. Pat. No. 2,388,678 of Dahlander and U.S. Pat. No. 4,127,184 to Strohmeyer.

U.S. Pat. No. 4,231,449 to Laurita discloses a foldable ladder having inwardly foldable links. However, the construction of the links would make the ladder heavy and costly to produce.

In order for an escape ladder to be commercially appealing and capable of use in an emergency, it must not be complicated but must be light weight. The construction must be simple and capable of use by women and children. The cost of the ladder should be such as to make it available to lower income groups.

OBJECTS AND SUMMARY OF THE INVENTION

It is an object of the present invention to provide an inexpensive flexible ladder which can be utilized in emergencies.

It is a further object of the invention to provide a light weight foldable ladder for use in escaping from a dwelling which will extend its length without tangling.

It is a still further object of the invention to provide a foldable ladder which can be collapsed into a small space for storage.

It is yet still a further object to provide a low cost ladder that is easy to construct and not complex in use.

These and other objects of the invention can be achieved by providing a foldable ladder of the type having a plurality of rigid steps that are operable between an operating position in which the ladder is suspended from an elevated structure such as a dwelling, and a folded position in which the steps are proximate to each other. The ladder contains a pair of inwardly folding arms connecting the steps at each end that are pivotably connected on each step and are pivotable about a rod assembly connecting each pair of arms together. Advantageously, there is provided means for extending the ladder away from the structure.

The rod assembly is preferably comprised of a rod extending between a pair of the inwardly folding arms and contains at least one sleeve which permits the arms to pivot freely about the rod. The sleeves are preferably composed of a slippery or lubricating plastic material such as TEFLON so as to facilitate rotation.

Connection of the folding arms to the steps can also be accomplished with a rod assembly as described so that the rotation at the step is easily accomplished when the ladder is extended. A rod assembly may be at each connecting point of the arms and the steps. However, it is also contemplated that a single rod could extend through two sides of the step and be associated with two arms. The rods facing the elevated structure may be elongated so as to maintain the step away from the structure and provide greater foot space when using the ladder.

At each of the points of rotation that the arms are connected, a self-lubricating or plastic washer such as a TEFLON washer may be utilized so as to ensure free rotation.

The construction of the ladder is such that all parts can be easily machined, stamped or extruded.

Other objects and a fuller understanding of the invention will be had by referring to the following description and claims of a preferred embodiment, taken in conjunction with the accompanying drawings, wherein like reference characters refer to similar parts throughout the several views.

DESCRIPTION OF THE PREFERRED EMBODIMENT OF THE INVENTION

Figure 1:
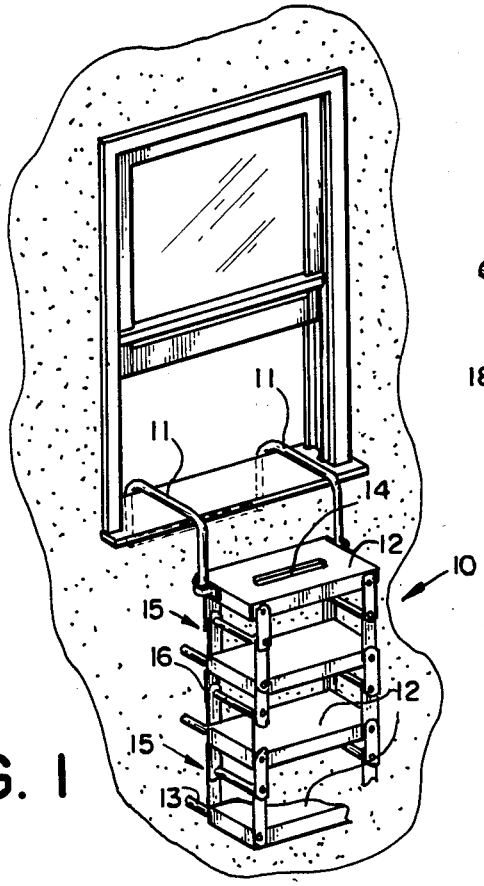
FIG. 1 is a perspective view of a partially open ladder of the invention.

Although specific terms are used in the following description for the sake of clarity, these terms are intended to refer only to the particular structure of the invention selected for illustration in the drawings, and are not intended to define or limit the scope of the invention.

As seen in FIG. 1, the foldable ladder of the invention 10 comprises a plurality of steps 12 which are joined about their ends by links 15 which are pivotally secured to the steps 12. The ladder 10 is provided with protrusions 13 along the side facing the structure from which it extends. An opening 14 may be placed in the steps to allow for additional gripping of the ladder when in use.

The ladder 10 may also be provided with a holding means 11 for securing the ladder to a structure or dwelling when in use. The simplest form of holding means could take the form of means which is permanently secured to the structure by any conventional means.

Figure 2:
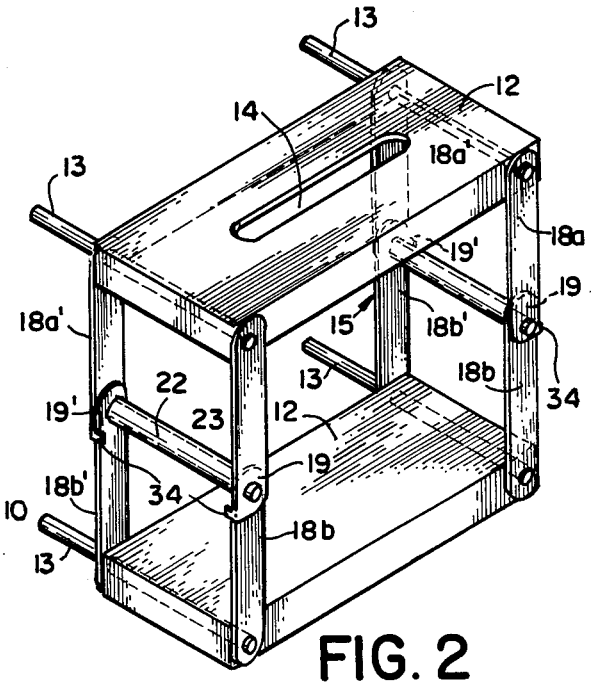
FIG. 2 is an enlarged fragmentary view, partially in section of connections between steps.

In FIG. 2, the links 15 are shown as a pair of arms 18*a*, 18*b* which pivot about point 19 on one side of the ladder 10, and arms 18*a*′, 18*b*′ on the other side which pivot about point 19′. The arms 18*a*, 18*b* are connected to arms 18*a*′, 18*b*′ by a rod assembly 20 which forms the pivots 19, 19′ and helps maintain rigidity. The links 15 are connected at each side to the steps by pins 13. Preferably, the pins 13 protrude from the steps 12 so as to maintain the steps from the structure from which it is suspended. In lieu of protruding pins, the steps may be formed with a protrusion.

Figure 3:
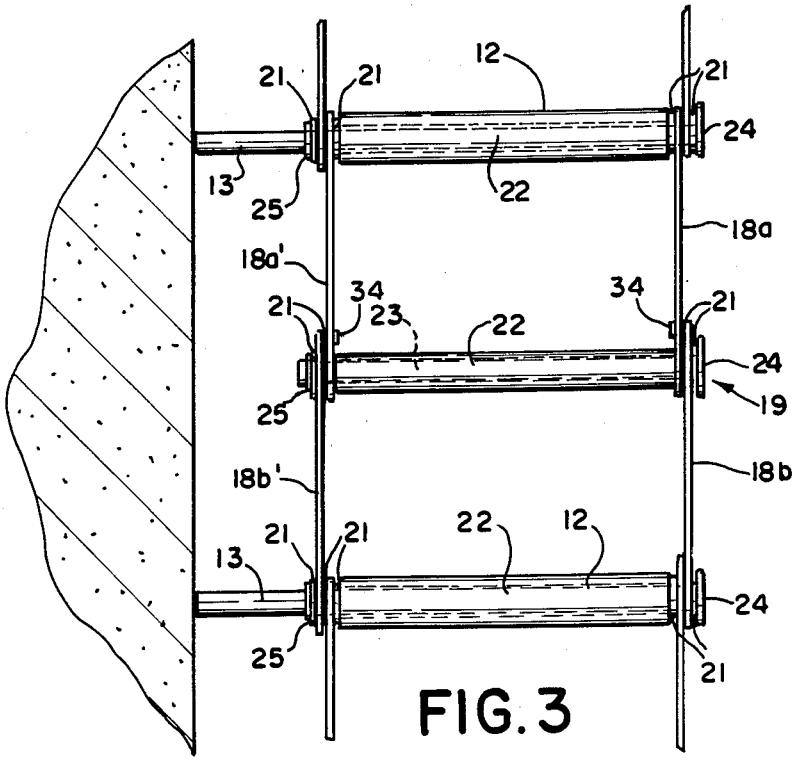
FIG. 3 is a side view of section of FIG. 2.

FIG. 3 illustrates how the ladder 10 is maintained away from a wall structure by means of the protruding rods 13. To reduce friction and to facilitate rotation lubricating washers 21 are placed about pivot or rotation points. Preferably the washers 21 are of the self lubricating type, for example, they comprise TEFLON washers.

Further, as seen in FIG. 3, the arms 18*a* and 18*b* need not be connected to associated arms 18*b* and 18*b'*. They are rotatable about an assembly of a pin 23 having a self-lubricating sleeve 23 which is preferably a plastic material such as TEFLON.

The pins 23 are maintained by a locking means 26 which may be a cotter pin in an aperture or a locking cap.

The arms 18*a* 18*a'* and 18*b*, 18*b'* are connected to the steps through a pin 13 having an enlarged head 24 which is within a sleeve 22. The pins 13 are held in place with a locking means 25.

Figure 4:
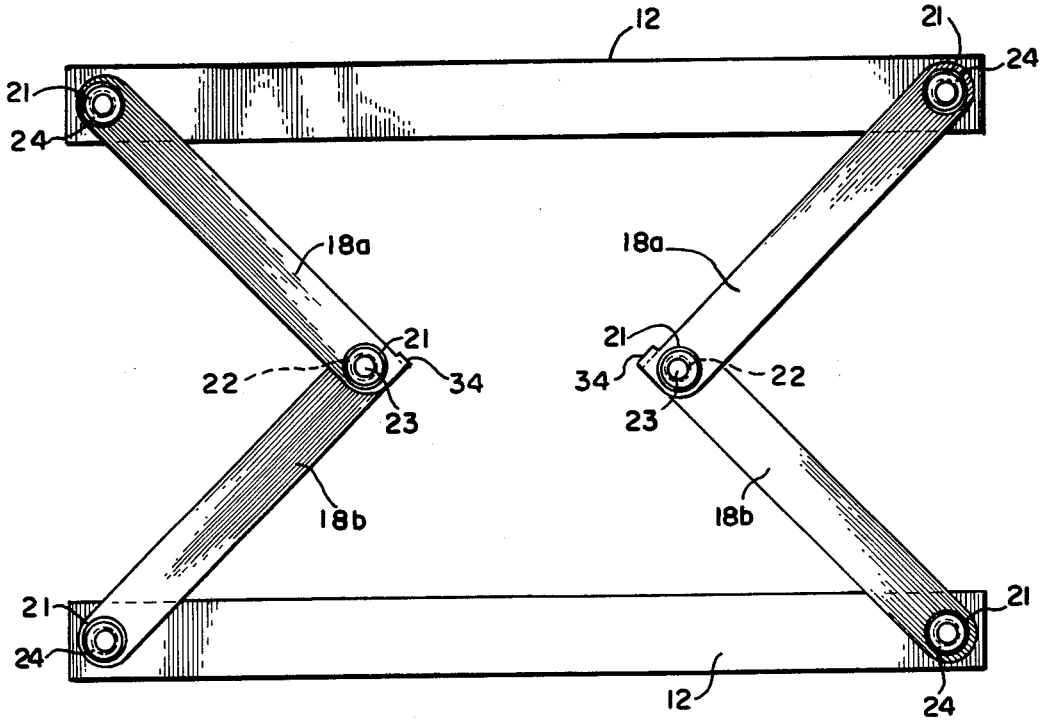
FIG. 4 is a front view of the section of FIG. 2.

As seen in FIG. 4, the steps are recessed and the arms 18*a*, 18*b* and 18*a'*, 18*b'* fold inwardly so as to be within the recess when stored. The preferred direction of folding links 15 is inwardly as seen in FIG. 4. To help restrain folding in the outward direction, stop means may be provided.

The ladder may also be provided with apertures such as hand holds 14 in the steps 12 for the convenience of a person using the ladder. The steps 12 may also be formed with ridges, molded or otherwise formed therein. These ridges act to provide a relatively non-slip surface on the steps 12. Other non-slip surfaces may be provided instead, as would be evident to a person skilled in the art.

When the ladder is intended for use as a fire escape means, the ladder may be too long to fold conveniently without additional aid. Therefore, apertures 14 may be formed in the steps 12 essentially aligned with each other and a rope or similar means (not shown) can be passed through these apertures and be attached to the bottom step. One need only pull up on the rope, by hand or with a simple winch device (not shown), to fold the ladder for storage.

Other uses for a foldable ladder as herein described, would be obvious to persons using foldable ladders. An example of such a use would be in marine applications wherein a ladder is often used to board a boat from the water.

The material from which the ladder should be manufactured will depend on its final use. Thus, for fire escape purposes, aluminum, a flame-retarding polymer or similar material (Lexan - S.E., A.B.S., glass-filled material, fiber-filled material) may be used. These materials for the most part, may be conveniently molded into appropriate parts for both the steps and the linkages. The pivot pins may also be of a synthetic polymer such as KEVLAR or of a metal such as steel.

Figure 5:
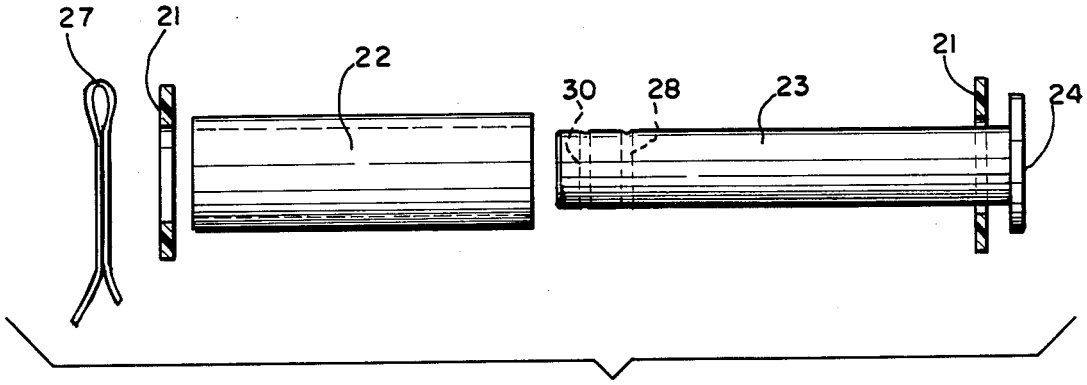
FIG. 5 is an enlarged view of the rod assembly.

As shown in FIG. 5, the rod assembly is constructed so as to permit substantially frictionless rotation of the pins 23 so that the steps 12 will extend downwardly because of their weight when used. Therefore, there is provided a self-lubricating plastic sleeve 22 over the pin 23 and self-lubricating washers 21 which will be situated adjacent the steps 12. The pin 23 is held in position by the enlarged head 24 on one side and a locking means such as a cotter pin 27 and aperture 28 on the other side.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A foldable ladder of the type having a plurality of rigid steps and being operable between an operating position in which said ladder is suspended from an elevated structure and at least the majority of said steps are supported below said structure, and spaced apart from each other in a substantially parallel arrangement, and, respectively, a folded position in which said steps are disposed in close proximity to each other, said ladder comprising a pair of spaced inwardly folding arms at opposite sides of each step in a substantially parallel arrangement, each of said pair of arms being connected by a first rod assembly comprised of a rod and a spacer sleeve rotatable about said rod and spacing a pair of arms, each of said arms being pivoted about said rod assembly, each of said arms being further pivotably connected at each end to adjacent steps by a second rod assembly comprised of a rod and a spacer sleeve rotatable about said rod and spacing a pair of arms, said steps being pivotable on said rods of said second rod assembly, and means for extending said ladder away from said structure.

2. The ladder of claim 1 wherein said means extending said ladder away from said structure comprises said rod connecting said arms to the steps.

3. The ladder of claim 1 wherein each of said arms comprises a pair of unconnected parts pivotally associated about said rod assembly.

4. The ladder of claim 1 including at least one lubricating washer at each pivotable part.

5. The ladder of claim 4 wherein said lubricating washer is a TEFLON washer.

6. The ladder of claim 1 wherein the lower portion of each step is recessed so as to cover said arms when the ladder is in a folded position.

* * * * *